US006905185B2

(12) United States Patent
Nakayama

(10) Patent No.: US 6,905,185 B2
(45) Date of Patent: Jun. 14, 2005

(54) INKJET PRINTING APPARATUS, WITH PLURAL PRINTHEADS AND CONTROL CIRCUIT

(75) Inventor: Toru Nakayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/905,875

(22) Filed: Jul. 17, 2001

(65) Prior Publication Data

US 2002/0021316 A1 Feb. 21, 2002

(30) Foreign Application Priority Data

Jul. 19, 2000 (JP) ..... 2000-219563

(51) Int. Cl.[7] ..... B41J 29/38
(52) U.S. Cl. ..... 347/12; 347/9; 347/5
(58) Field of Search ..... 347/9, 11, 10, 347/145, 180, 43, 42, 12, 13, 211, 5

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,723,129 A | | 2/1988 | Endo et al. | 346/1.1 |
| 4,740,796 A | | 4/1988 | Endo et al. | 346/1.1 |
| 5,790,140 A | * | 8/1998 | Koizumi et al. | 347/12 |
| 6,137,509 A | * | 10/2000 | Hayasaki | 347/59 |
| 6,206,503 B1 | * | 3/2001 | Kimura | 347/43 |

FOREIGN PATENT DOCUMENTS

| | | | |
|---|---|---|---|
| EP | 0 641 658 A2 | * | 3/1995 |
| EP | 0 677 388 | | 10/1995 |
| JP | 59-123670 | | 7/1984 |
| JP | 59-138461 | | 8/1984 |
| JP | 6-305148 | | 11/1994 |
| JP | 7-76080 | | 3/1995 |
| JP | 7-276638 | | 10/1995 |
| JP | 8-72245 | | 3/1996 |

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

A shift register stores printing data in synchronism with a transfer clock. A latch circuit temporarily latches data having a predetermined number of bits to the shift register in response to a data latch signal. A shift register stores block data in synchronism with a transfer clock. A latch circuit temporarily latches data having the predetermined number of bits to the shift register in response to a block data latch signal. Each AND gate receives a block selection signal from a printing block selection unit, a printing data selection signal corresponding to a printing dot from a printing data supply unit, and an energization time selection signal. An output from the AND gate turns on/off a switching transistor. As a result, a heater is heated to discharge ink droplets.

4 Claims, 11 Drawing Sheets

INKJET PRINTING APPARATUS, WITH PLURAL PRINTHEADS AND CONTROL CIRCUIT

FIELD OF THE INVENTION

The present invention relates to an inkjet printhead, inkjet printing apparatus, and inkjet printhead driving circuit for discharging ink to print an image such as a character on a printing medium.

BACKGROUND OF THE INVENTION

An inkjet printing method of discharging ink to print an image is widely used for printers, copying machines, facsimile apparatuses, and the like because of small noise, low running cost, easy downsizing of an apparatus, and facilitation of color image printing.

An example of printheads used for the inkjet printing method is a multi-nozzle inkjet head having a plurality of nozzles.

In this printhead, electrothermal energy transducers (heaters) are arranged together with wiring lines at equal intervals on, e.g., a silicon substrate, resin layers are stacked between the respective electrothermal energy transducers to form partitions, and a liquid channel formation plate is bonded to each partition to form an orifice.

FIG. 10 is a circuit diagram showing a conventional driving circuit for driving a printhead.

As shown in FIG. 10, n (n is a positive integer) AND gates 2-1, 2-2, 2-3, 2-4, . . . , 2-n are arranged for n (n is a positive integer) electrothermal energy transducers 1-1, 1-2, 1-3, 1-4, . . . , 1-n, respectively. Each of the AND gates 2-1, 2-2, 2-3, 2-4, . . . , 2-n receives a block selection signal (HE0, HE1, BE0 (BE0_0, BE0_1)) corresponding to sequential block driving of the electrothermal energy transducers 1, a printing data signal (IDATA), and an energization time setting signal (HC).

Printing data (IDATA) equal in the number of bits to the electrothermal energy transducers 1-1, 1-2, 1-3, 1-4, . . . , 1-n are sequentially transferred to a shift register 4 of a printing data supply unit 40 in synchronization with a printing data transfer clock (DCLK). After all the data are input, they are read in a latch circuit 3 in response to input of a latch signal (DLAT).

Block selection signals (HE0, HE1, BE0 (BEO_0, BE0_1)) corresponding to sequential block driving of the electrothermal energy transducers 1-1, 1-2, 1-3, 1-4, . . . , 1-n are input. Only while the energization time setting signal (HC) is ON, the printing data (IDATA) are selectively supplied to the electrothermal energy transducers 1-1, 1-2, 1-3, 1-4, . . . , 1-n. Then, ink is discharged from orifices by the action of bubbles generated by thermal energy.

However, the conventional printhead driving circuit shown in FIG. 10 requires many signal lines (EI, IDATA-BK, IDATA-C, IDATA-M, IDATA-Y, DCLK, DLAT, HE0, HE1, BE0 (BE0_0, BE0_1), HC-BK, HC-C, HC-M, and HC-Y) extending from a host head control circuit to BK, C, M, and Y head driving circuits arranged for respective, black, cyan, magenta, and yellow inks, as shown in FIG. 11, in performing sequential/divisional block driving because the driving blocks of the printhead are determined by a plurality of block selection signals (HE0, HE1, BE0 (BE0_0, BE0_1). If the number of blocks subjected to sequential/divisional block driving increases, the number of signal lines extending from the host head control circuit must be increased, resulting in a complicated circuit arrangement.

SUMMARY OF THE INVENTION

The present invention has been made to overcome the conventional drawbacks, and has as its object to provide an inkjet printing method and apparatus capable of decreasing the number of signal lines necessary for divisional block driving of a printhead.

To overcome the conventional drawbacks and achieve the object, according to the present invention, an inkjet printhead having a plurality of orifices for discharging ink, and discharge energy generation elements arranged at the respective orifices to discharge the ink comprises ink discharge signal output means for receiving printing data and outputting ink discharge signals corresponding to printing dots, block data input means for inputting serial block data for dividing the plurality of orifices into a plurality of blocks and driving the blocks in correspondence with the ink discharge signals, holding means for temporarily holding a signal output from the block data input means, block selection signal output means for outputting block selection signals corresponding to the plurality of blocks, and driving signal output means for outputting driving signals for driving the discharge energy generation elements for discharging the ink by using the signals output from the ink discharge signal output means and the block selection signal output means.

According to the present invention, an inkjet printing apparatus comprises an inkjet printhead having a plurality of orifices for discharging ink, discharge energy generation elements arranged at the respective orifices to discharge the ink, ink discharge signal output means for receiving printing data and outputting ink discharge signals corresponding to printing dots, block data input means for inputting serial block data for dividing the plurality of orifices into a plurality of blocks and driving the blocks in correspondence with the ink discharge signals, holding means for temporarily holding a signal output from the block data input means, block selection signal output means for outputting block selection signals corresponding to the plurality of blocks, and driving signal output means for outputting driving signals for driving the discharge energy generation elements for discharging the ink by using the signals output from the ink discharge signal output means and the block selection signal output means, and a control circuit having printing data output means for outputting the printing data to the ink discharge signal output means, and block data output means for outputting the block data to the block selection signal output means.

According to the present invention, an inkjet printhead driving circuit for an inkjet printhead having a plurality of orifices for discharging ink, and discharge energy generation elements arranged at the respective orifices to discharge the ink comprises ink discharge signal output means for receiving printing data and outputting ink discharge signals corresponding to printing dots, block data input means for inputting serial block data for dividing the plurality of orifices into a plurality of blocks and driving the blocks in correspondence with the ink discharge signals, holding means for temporarily holding a signal output from the block data input means, block selection signal output means for outputting block selection signals corresponding to the plurality of blocks, and driving signal output means for outputting driving signals for driving the discharge energy generation elements for discharging the ink by using the signals output from the ink discharge signal output means and the block selection signal output means.

As described above, the present invention can implement sequential/divisional block driving with a small number of signal lines by using ink discharge signals and block selection signals and outputting driving signals for driving discharge energy generation elements for discharging ink. Printing data and block data can be transferred parallel to each other, so the printing speed does not decrease.

The block data is input in the form of serial data, and the signal output from the block data input means is temporarily held. The data input to the block data input means can be changed to change the driving order of the blocks.

The driving signal output means preferably receives a driving start signal for controlling the start time of application of driving signals to the discharge energy generation elements, after receiving the driving start signal, sequentially receives ink discharge signal and block selection signals, and outputs driving signals for driving the discharge energy generation elements for discharging ink. Ink discharge signals and block selection signals can be sequentially input by inputting one driving start signal, and sequential/divisional block driving can be achieved by a small number of signal lines.

The discharge energy generation elements are preferably thermal energy transducers for transducing electrical energy into thermal energy in order to generate thermal energy to be applied to ink. In this case, the thermal energy transducers can be driven by a small number of signal lines.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Preferred embodiments according to the present invention will be described in detail below with reference to the accompanying drawings.

[Schematic Structure of Inkjet Printing Apparatus]

Figure 1:
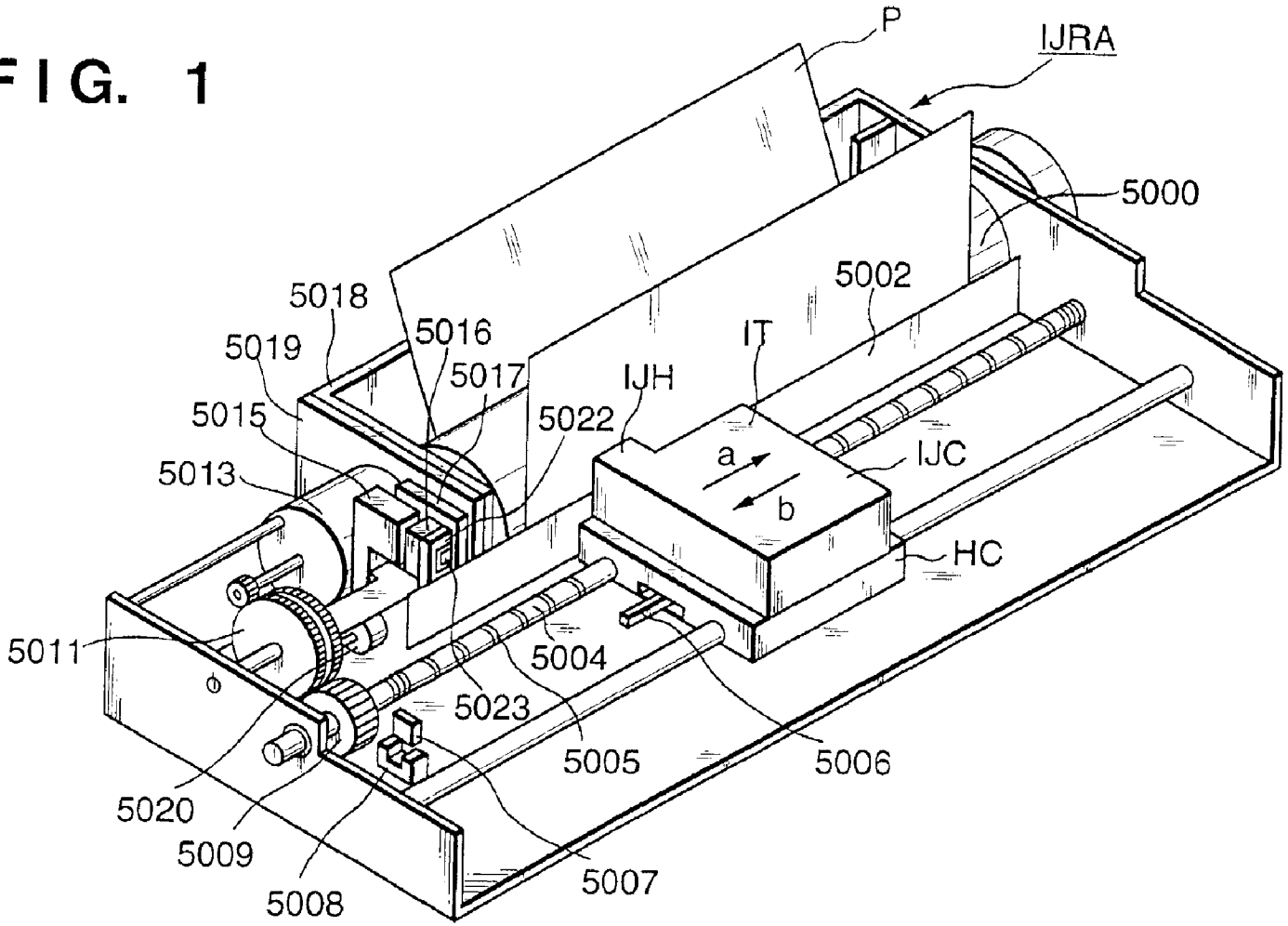
FIG. 1 is a perspective view schematically showing the outer appearance of an inkjet printer IJRA according to a representative embodiment of the present invention.

FIG. 1 is a perspective view schematically showing the outer appearance of an inkjet printer IJRA according to a representative embodiment of the present invention.

In FIG. 1, a pin (not shown) is attached to a carriage HC which engages with a helical groove 5005 of a lead screw 5004 which rotates via driving force transfer gears 5009 and 5011 while interlocking with forward/reverse rotation of a driving motor 5013. The carriage HC can be reciprocally moved in directions indicated by arrows a and b. The carriage HC supports an inkjet cartridge IJC. Reference numeral 5002 denotes a sheet press plate which presses a sheet against a platen 5000 in a carriage moving direction; 5007 and 5008, photocouplers serving as home position detection means for detecting the presence of a carriage lever 5006 in a corresponding region and switching the rotational direction of the motor 5013; 5016, a member which supports a cap member 5022 which caps the front end of the printhead; 5015, a suction means which sucks the interior of the cap and performs suction recovery of the printhead via an intra-cap opening 5023; 5017, a cleaning blade; and 5019, a member capable of moving this blade back and forth. The cleaning blade 5017 and member 5019 are supported by a main body support plate 5018. The blade is not limited to this, and a known cleaning blade can be applied to the present invention. Reference numeral 5021 denotes a lever which starts suction for suction recovery, and moves upon movement of a cam 5020 engaging with the carriage. A driving force from the driving motor is controlled by a known transfer means such as a clutch switch.

Capping, cleaning, and suction recovery are executed by desired processes at corresponding positions by the operation of the lead screw 5004 when the carriage comes to the home-position region. However, any processes can be applied to the present invention so long as desired processes are effected at known timings.

[Arrangement of Control Circuit]

Figure 2:
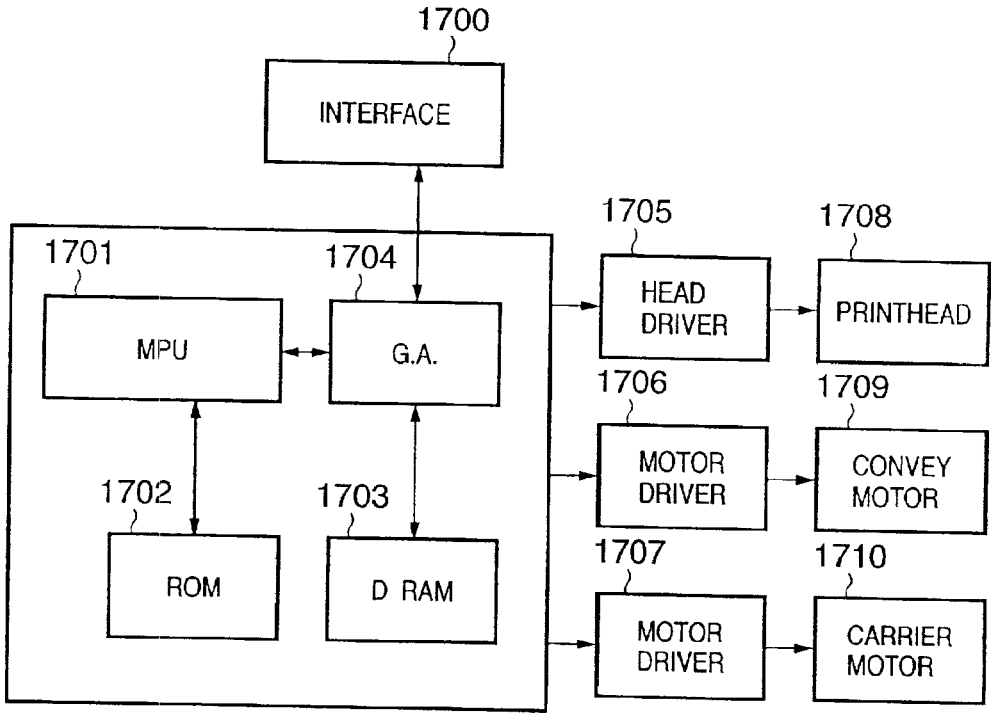
FIG. 2 is a block diagram showing the arrangement of a control circuit for the inkjet printer IJRA.

A control arrangement for executing printing control of the above-described apparatus will be described. FIG. 2 is a block diagram showing the arrangement of a control circuit for the inkjet printer IJRA.

In FIG. 2 showing the control circuit, reference numeral 1700 denotes an interface for inputting a printing signal; 1701, an MPU; 1702, a program ROM which stores a control program executed by the MPU 1701; 1703, a dynamic RAM for storing various data (the printing signal, printing data supplied to the head, and the like); 1704, a gate array which controls supply of printing data to a printhead 1708, and also controls data transfer between the interface 1700, the MPU 1701, and the RAM 1703; 1710, a carrier motor for carrying the printhead 1708; 1709, a convey motor for conveying a printing sheet; 1705, a head driver for driving the head; and 1706 and 1707, motor drivers for respectively driving the convey motor 1709 and carrier motor 1710.

An operation with this control arrangement will be explained. When a printing signal is input to the interface 1700, the printing signal is converted into printing data between the gate array 1704 and the MPU 1701. Then, the motor drivers 1706 and 1707 are driven, and the printhead is driven in accordance with the printing data sent to the head driver 1705 to print the data.

The inkjet printhead to be exemplified as an embodiment has a plurality of electrothermal energy transducers (heaters), and generates discharge energy by selectively supplying a current to the electrothermal energy transducers in correspondence with image data to be printed. This printhead comprises a driving circuit for completing transfer input of image data within one cycle and receiving a block latch signal to perform divisional driving control of the heaters.

[Head Structure]

Figure 3:
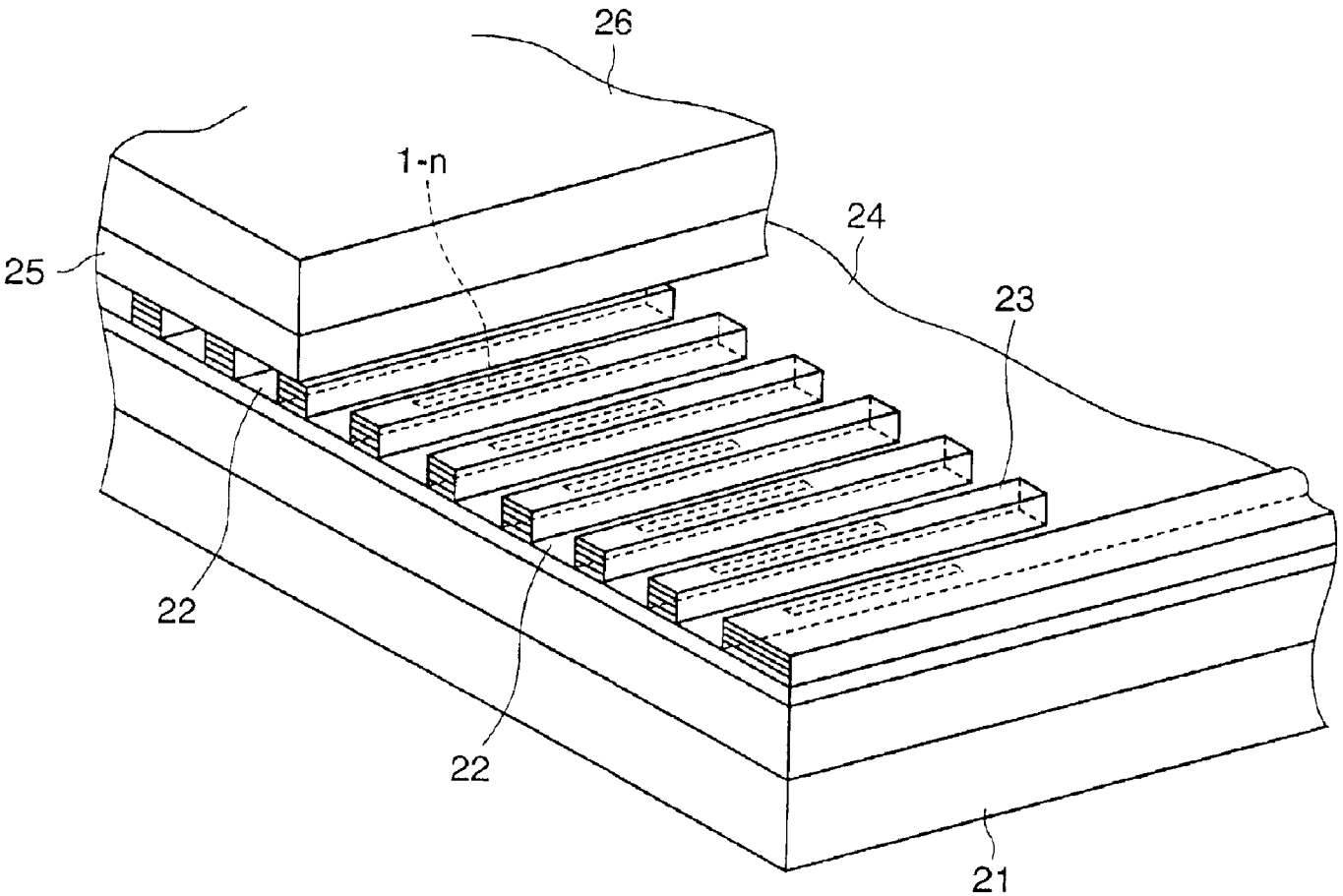
FIG. 3 is a perspective view showing the structure of an inkjet printhead according to the embodiment.

FIG. 3 is a perspective view showing the structure of the inkjet printhead according to the embodiment.

In FIG. 3, reference numerals 1-1, 1-2, 1-3, 1-4, . . . , 1-n denote heating resistors each of which constitutes an electrothermal transducer for generating heat in accordance with energization, generating bubbles in ink, and discharging the ink, and is formed together with wiring lines on a substrate 21 by the same manufacturing process as that of a semiconductor; 25, a liquid channel formation member for forming each orifice 22 and each liquid channel 23 communicating with the orifice 22 in correspondence with each of the heating resistors 1-1, 1-2, 1-3, 1-4, . . . , 1-n; 24, a liquid chamber which is shared by the liquid channels 23 and stores ink supplied from an ink supply source (not shown); and 26, a top plate.

[First Embodiment]

Figure 4:
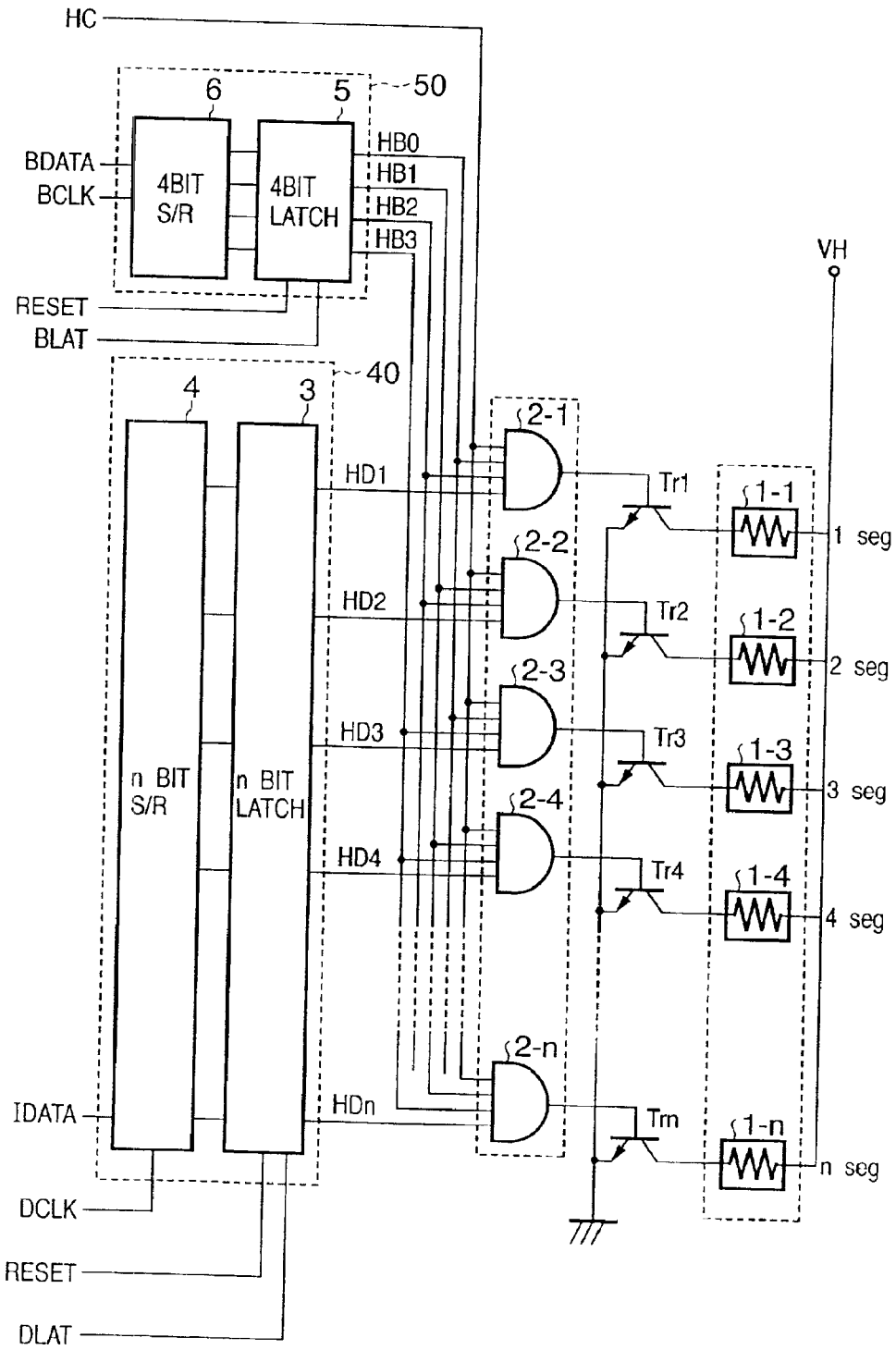
FIG. 4 is a block diagram showing the arrangement of a head driving circuit for driving the printhead shown in FIG. 3.

FIG. 4 shows the arrangement of a head driving circuit for driving the printhead shown in FIG. 3. The head driving circuit is formed as a substrate 21 by a manufacturing process using the same film formation techniques as those of a semiconductor circuit. Note that as the structure of a printhead, orifices and channels are formed on the substrate 21 in correspondence with the electrothermal energy transducers.

In FIG. 4, reference symbol DCLK denotes a transfer clock for transferring printing data (IDATA). Reference numeral 4 denotes a shift register which stores the printing data (IDATA) in synchronism with the transfer clock (DCLK); and 3, a latch circuit which temporarily latches data having a predetermined number of bits (n bits in this embodiment) to the shift register 4 in response to a data latch signal (DLAT).

The shift register 4 and latch circuit 3 constitute a printing data supply unit 40 (broken line).

A printing block selection unit 50 (broken line) will be described.

Reference symbol BCLK denotes a transfer clock for transferring block data (BDATA). Reference numeral 6 denotes a shift register which stores the block data (BDATA) in synchronism with the transfer clock (BCLK); 5, a block data latch circuit which temporarily latches data having a predetermined number of bits (4 bits in this embodiment) to the shift register 6 in response to a block data latch signal (BLAT).

The shift register 6 and latch circuit 5 constitute the printing block selection unit 50.

N AND gates 2-1, 2-2, 2-3, 2-4, . . . , 2-n receive block selection signals (any two of HB0, HB1, HB2, HB3, . . . , HBm) from the printing block selection unit 50, a printing data selection signal (HD1, HD2, HD3, . . . , HDn) corresponding to a printing dot from the printing data supply unit 40, and an energization time selection signal (HC). An output from each of the AND gates 2-1, 2-2, 2-3, 2-4, . . . , 2-n turns on/off a corresponding switching transistor (Tr1, Tr2, Tr3, . . . , Trn), and one of the heaters 1-1, 1-2, 1-3, 1-4, . . . , 1-n which corresponds to the ON transistor (Tr1, Tr2, Tr3, . . . , Trn) is heated to discharge ink droplets.

Figure 6:
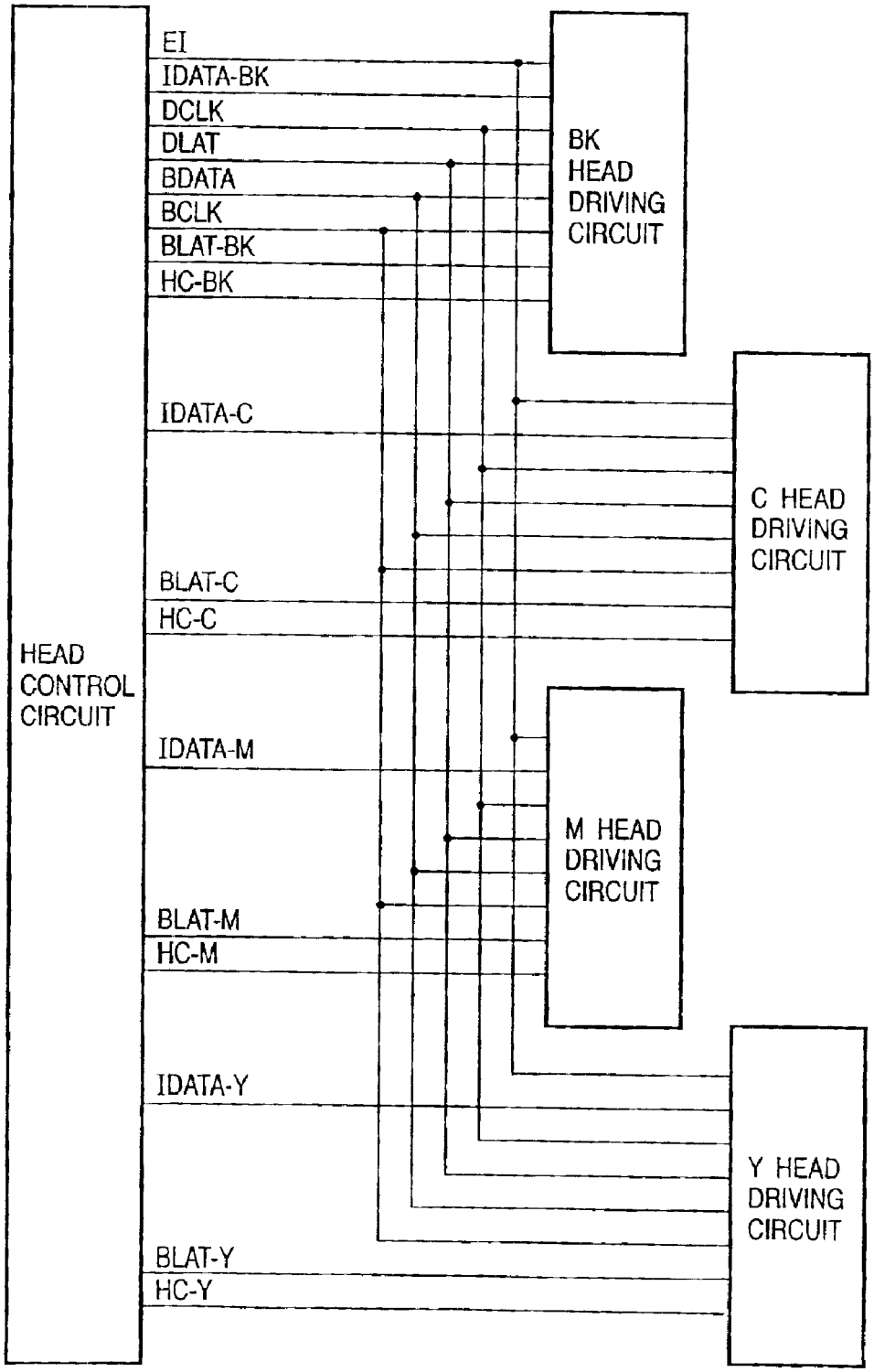
FIG. 6 is a block diagram showing an example of signal lines which connect head driving circuits to a head control circuit in the first embodiment.
Figure 11:
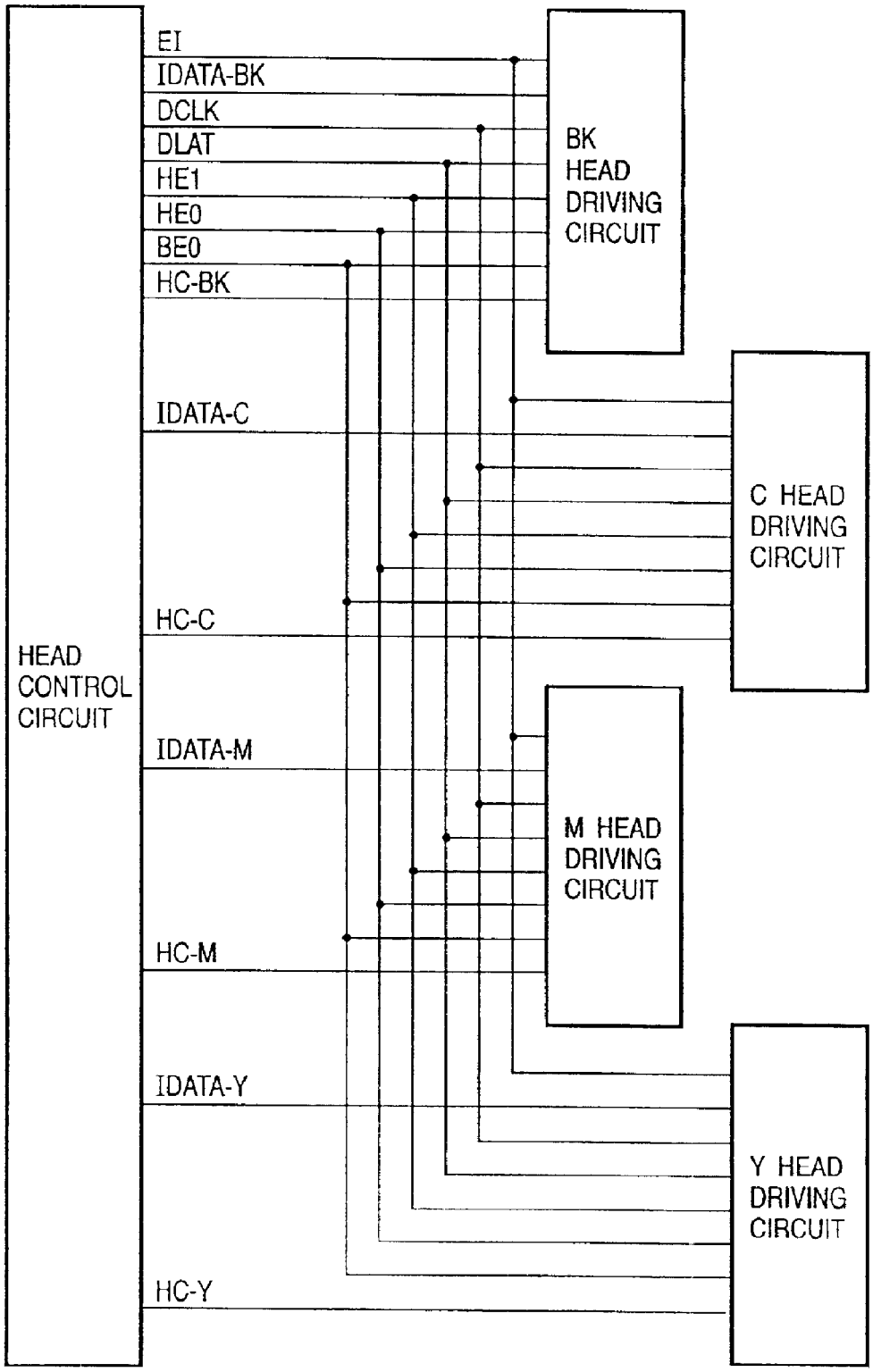
FIG. 11 is a block diagram showing an example of signal lines which connect conventional head driving circuits to a head control circuit.

To perform sequential/divisional block driving by the printhead driving circuit shown in FIG. 4, signal lines (EI, IDATA-BK, IDATA-C, IDATA-M, IDATA-Y, DCLK, DLAT, BDATA, BCLK, BLAT-BK, BLAT-C, BLAT-M, BLAT-Y, HC-BK, HC-C, HC-M, and HC-Y) smaller in number than those in FIG. 11 are laid out from a host head control circuit to BK, C, M, and Y head driving circuits arranged for respective, black, cyan, magenta, and yellow inks, as shown in FIG. 6. The number of blocks subjected to sequential/divisional block driving can be increased by controlling block data latch signals (BLAT-BK, BLAT-C, BLAT-M, and BLAT-Y). The number of signal lines extending from the host head control circuit need not be increased upon an increase in the number of blocks, and the circuit arrangement can be greatly simplified.

In this embodiment, the driving block designation shift register 6 receives the block data as serial data, and an output from this shift register 6 is held in the block data latch circuit 5. For this reason, by changing the data input to the shift register 6, the driving order of the blocks can be changed. In FIG. 6, signal lines connected to the BK, C, M, and Y head driving circuits arranged for the respective color inks are represented with -BK, -C, -M, and -Y which are suffixed to the printing data (IDATA), block data latch signal (BLAT), and energization time selection signal (HC).

The operation of the head driving circuit according to the first embodiment will be explained with reference to FIG. 5.

Figure 5:
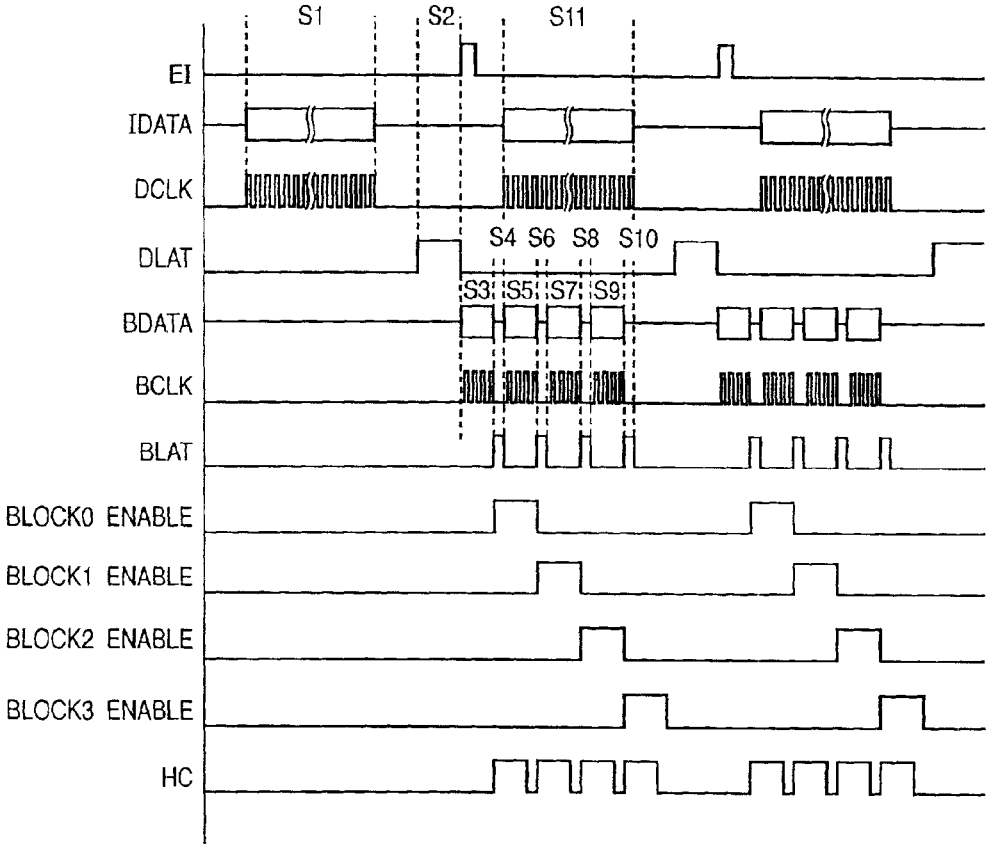
FIG. 5 is a waveform chart showing the operation of the head driving circuit shown in FIG. 4.

In FIG. 5, signals are not identified for the respective colors. The head driving circuit for each color operates in accordance with signals generated for the color.

N-bit printing data (IDATA) is read in the shift register 4 in synchronism with a transfer clock (DCLK) (S1).

The head control circuit as a component on the printing apparatus side outputs a latch signal (DLAT) upon the completion of transfer of the printing data (IDATA), and the head driving circuit of each head latches printing data of each dot in the latch circuit 3 (S2)

The head control circuit starts data transfer to the first driving block upon generation of a printing instruction pulse (EI), and block data (BDATA) is read in the shift register 6 of the head driving circuit in synchronism with a transfer clock (BCLK) (S3).

The head control circuit outputs a block data latch signal (BLAT) upon the completion of transfer of the block data (BDATA), and a block selection signal (HB) for the first driving block is latched in the latch circuit 5 of the head driving circuit (S4).

The head control circuit starts transfer to the next driving block after output of the latch signal (BLAT), and block data (BDATA) for the next driving block is read in the shift register 6 of the head driving circuit in synchronism with a transfer clock (BCLK) (S5).

After the driving time of the first block ends, the head control circuit outputs a latch signal (BLAT) and switches driving to the next driving block (S6).

In this way, printing block signals are repetitively transferred until the driving time of the final block ends (S7 to S10).

That is, as shown in FIG. 5, sequential/divisional block driving is implemented in correspondence with one printing instruction pulse (EI).

Since the head control circuit transfers the next printing data in correspondence with the printing instruction pulse (EI), transfer of the next printing data can be completed until divisional driving of the first block ends (S11). Printing data transfer and printing operation can be executed parallel to each other.

With the divisional block selection unit 50 and printing data supply unit 40, the number of signal lines necessary for data transfer can be reduced, realizing low cost.

The block selection unit 50 can be formed by the same semiconductor manufacturing process as that of the data generation unit 40 without increasing a new manufacturing process in the manufacture of the head driving circuit.

The number of divisional driving blocks is 4 in the first embodiment, but the present invention is not limited to the number of divisional driving blocks such as 8 blocks or 16 blocks.

Figure 7:
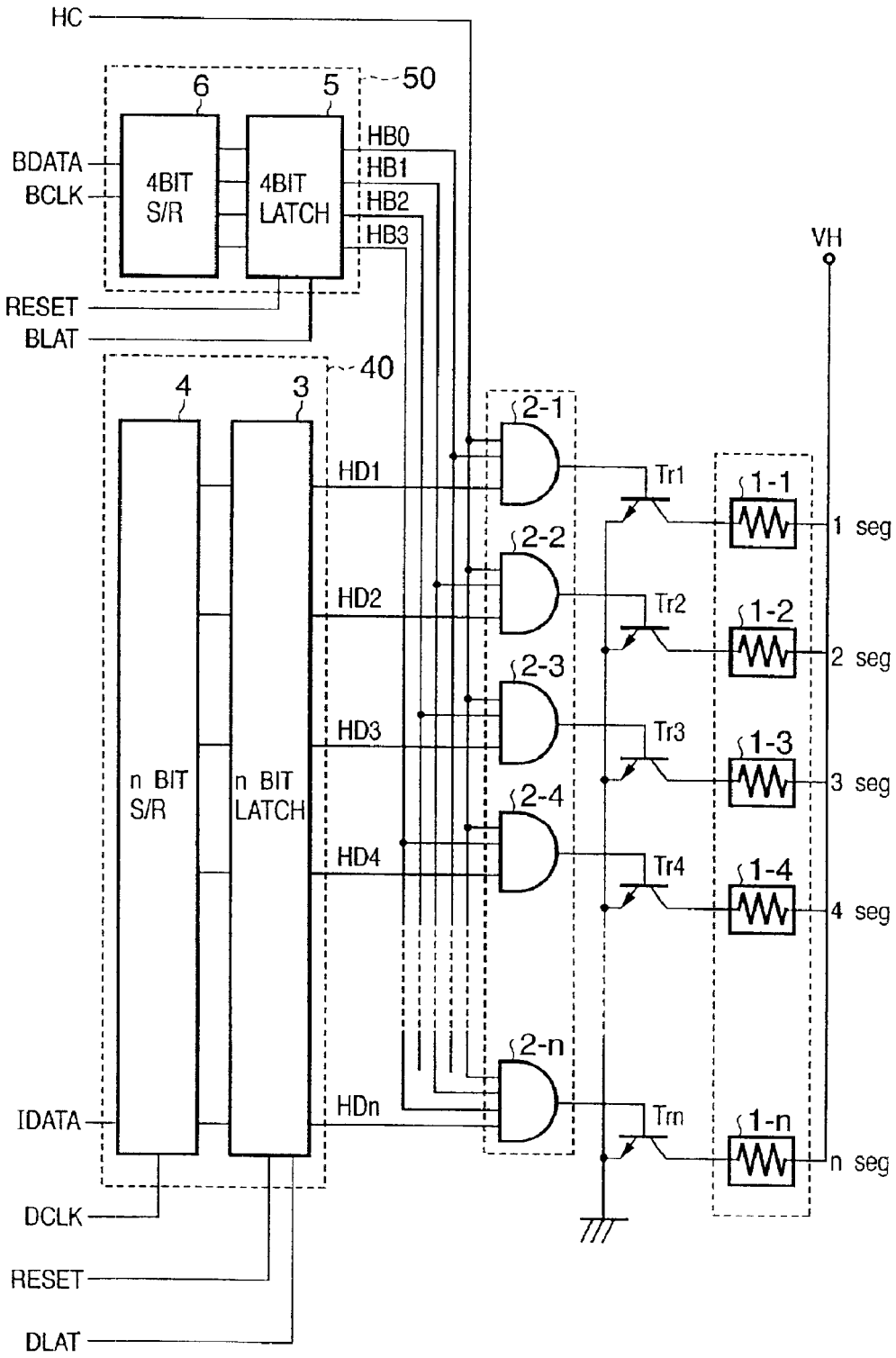
FIG. 7 is a block diagram showing the arrangement of a modification of the head driving circuit for driving the printhead shown in FIG. 4.

In the circuit arrangement shown in FIG. 4, any two of the block selection signals HB0, HB1, HB2, HB3, . . . , HBm are input to one AND gate 2-n. Alternatively, as shown in FIG. 7, one block selection signal may be input.

[Second Embodiment]

Figure 8:
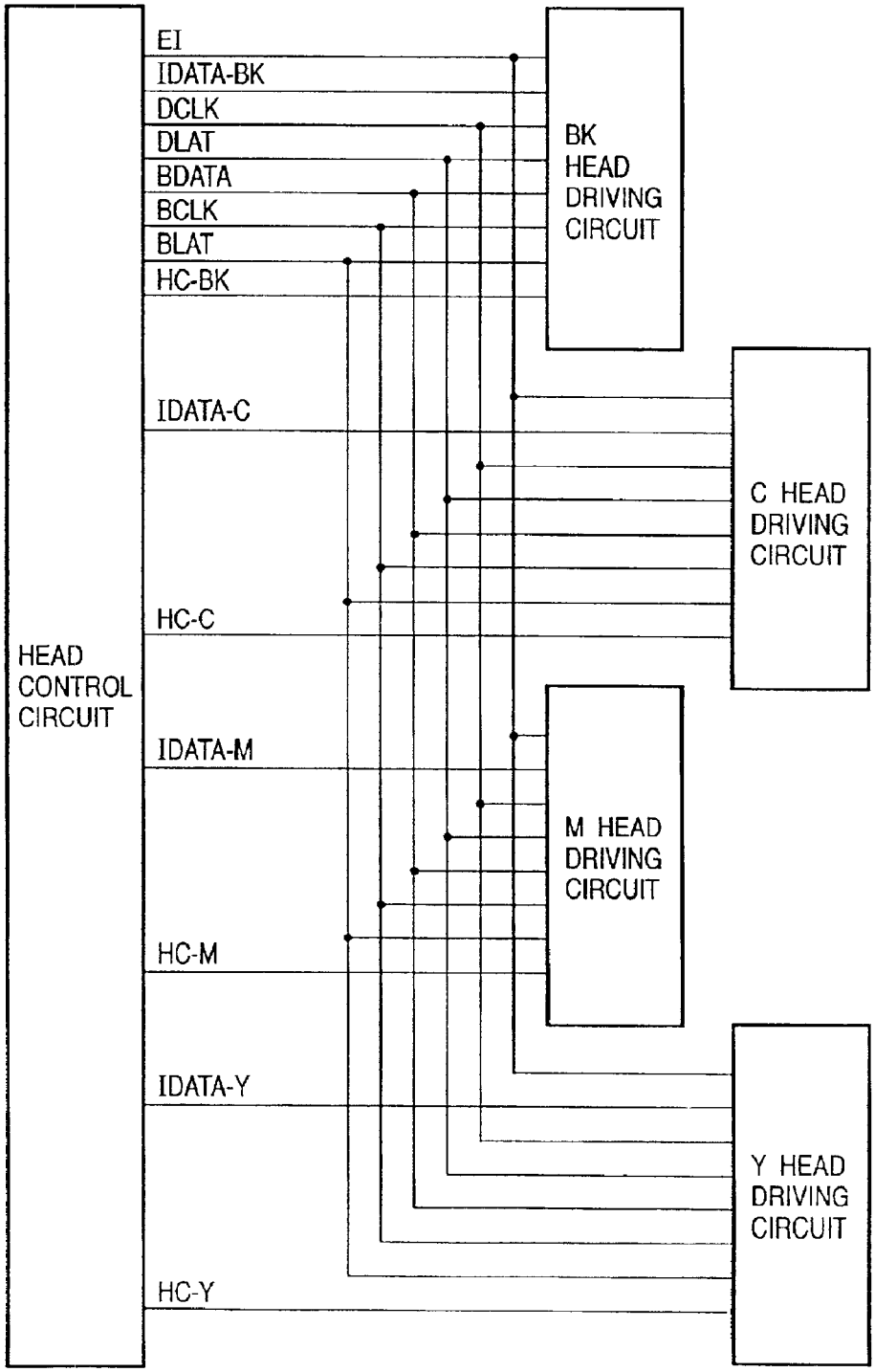
FIG. 8 is a block diagram showing an example of signal lines which connect head driving circuits to a head control circuit in the second embodiment.

FIG. 8 is a block diagram showing the arrangement of a head control circuit according to the second embodiment.

In FIG. 8, the same reference numerals as in the first embodiment denote the same parts, and a detailed description thereof will be omitted.

The head control circuit in the second embodiment adopts a common signal as block data latch signals (BLAT-BK, BLAT-C, BLAT-M, and BLAT-Y) input to BK, C, M, and Y head driving circuits arranged for respective color inks. Hence, the number of signal lines necessary for data transfer becomes smaller than in the first embodiment, realizing lower cost.

Figure 9:
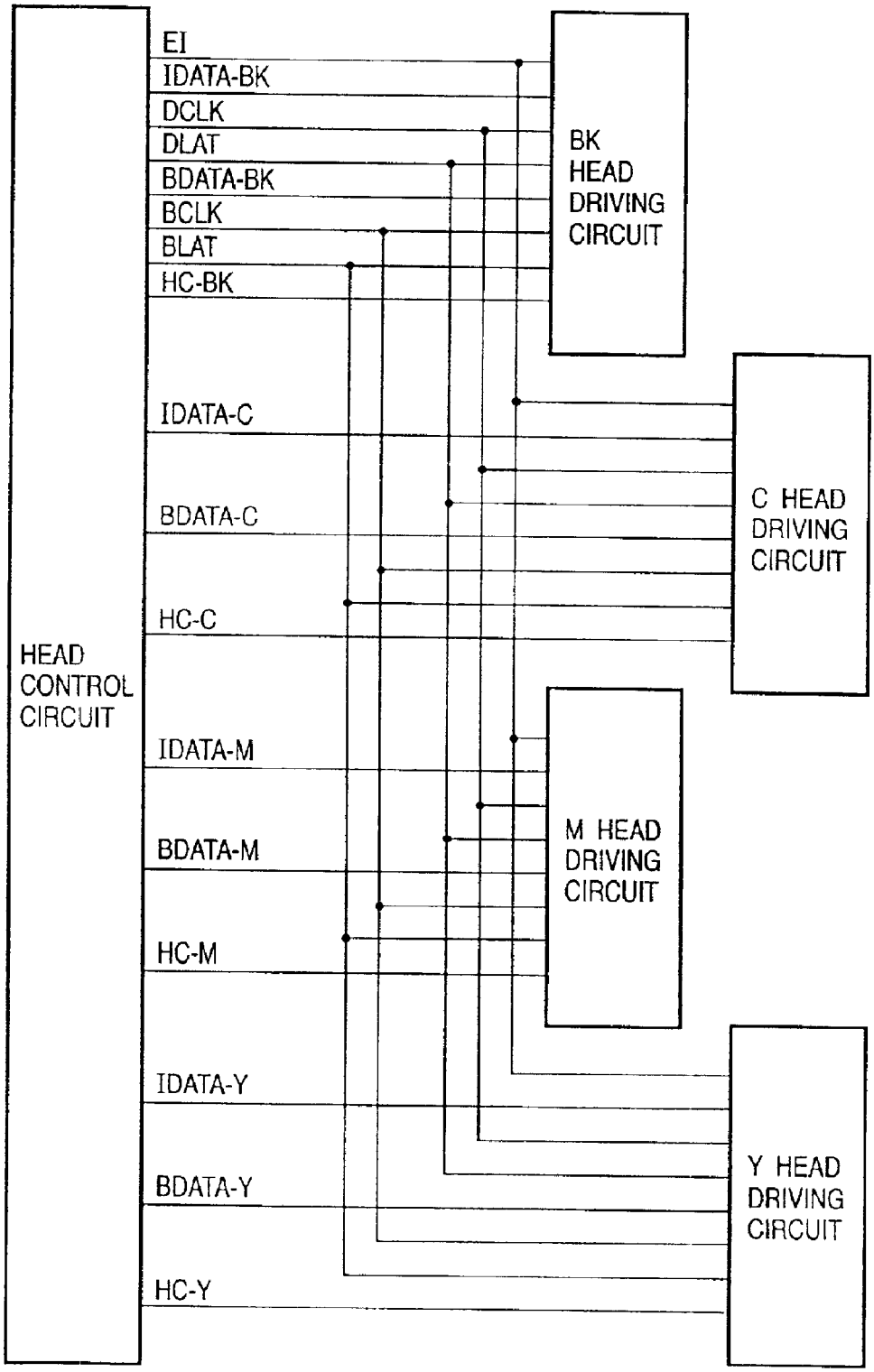
FIG. 9 is a block diagram showing an example of signal lines which connect head driving circuits to a head control circuit in the third embodiment.
Figure 10:
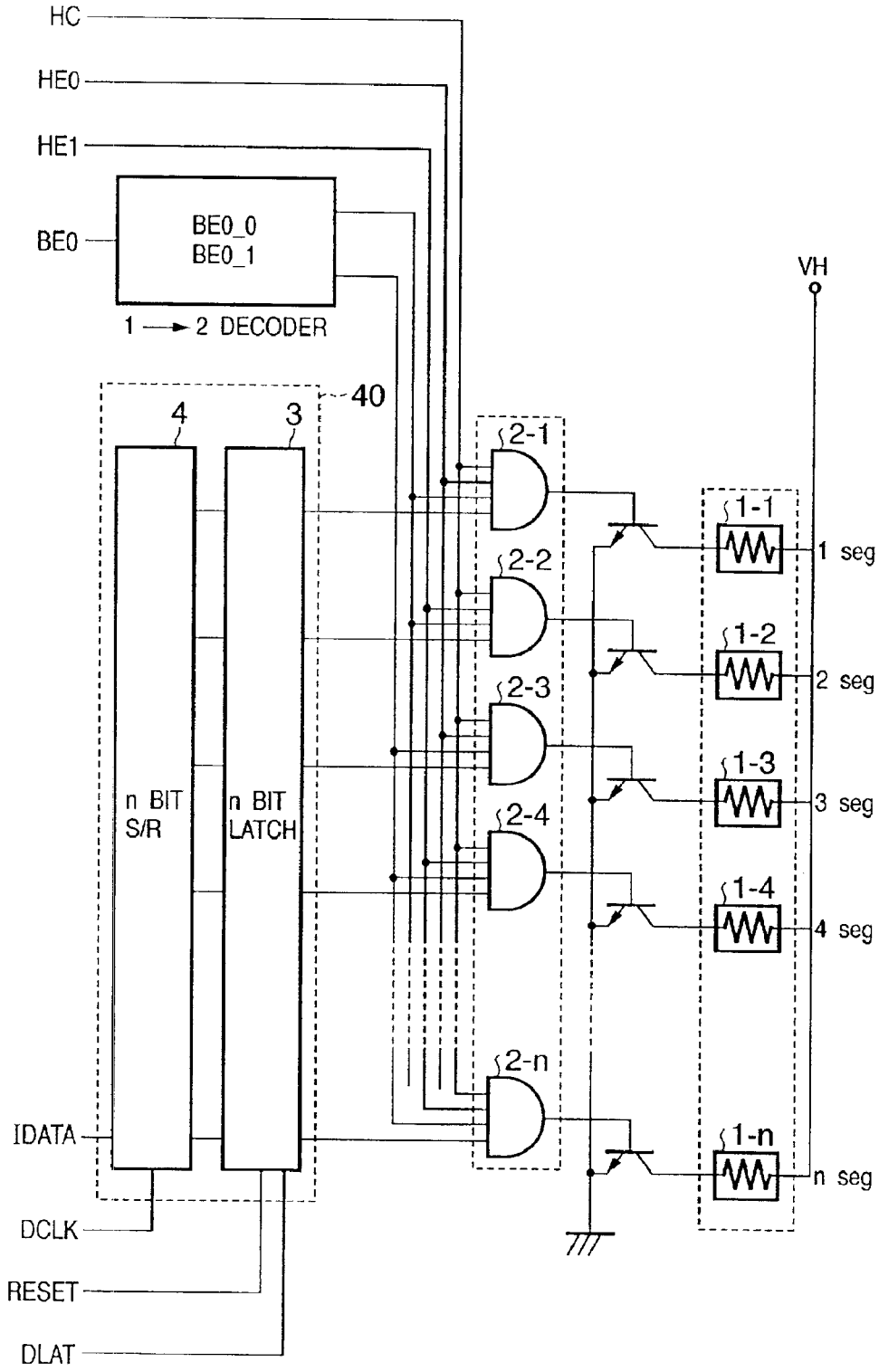
FIG. 10 is a block diagram showing a conventional printhead driving circuit.

FIG. 9 shows an arrangement for independently supplying the block data to each head. When the block data supplied from the head control circuit to each head driving circuit is changed, the block driving order (designation order) for each head can be changed.

Assume that heads are spaced apart from each other at a predetermined distance along the scanning direction of the carriage, and that the orifices of each head are arrayed in the convey direction of the printing medium (direction crossing the scanning direction of the carriage). In this case, when the block designation order between the heads and the way of supplying printing data are changed, positions where the heads print data on the printing medium can be adjusted by a block driving timing interval.

The above embodiments have been explained by assuming that a droplet discharged from a printhead is ink and that a liquid contained in an ink tank is ink. However, the content of the ink tank is not limited to ink. For example, the ink tank can also contain a processing solution to be discharged onto a printing medium to increase the fixing properties, water resistance, or quality of a printed image.

The above embodiments can increase the density and resolution of printing by using a system which includes a means (e.g., an electrothermal transducer or laser beam) for generating thermal energy as energy used to discharge ink and causes a state change of the ink by this thermal energy, among other inkjet printing systems.

As a representative arrangement or principle, it is preferable to use the basic principle disclosed in, e.g., U.S. Pat. No. 4,723,129 or 4,740,796. This system is applicable to both a so-called on-demand apparatus and continuous apparatus. The system is particularly effective in an on-demand apparatus because at least one driving signal which corresponds to printing information and which gives a rapid temperature rise exceeding nucleate boiling is applied to an electrothermal transducer which corresponds to a sheet or liquid channel holding a liquid (ink), thereby causing this electrothermal transducer to generate thermal energy and cause film boiling on the thermal action surface of a printhead, and consequently a bubble can be formed in the liquid (ink) in one-to-one correspondence with the driving signal. By growth and shrinkage of this bubble, the liquid (ink) is discharged from an orifice to form at least one droplet. This driving signal is more preferably a pulse signal because growth and shrinkage of a bubble are instantaneously appropriately performed, so discharge of the liquid (ink) having high response is achieved.

This pulse driving signal is preferably a signal described in U.S. Pat. No. 4,463,359 or 4,345,262. Note that superior printing can be performed by the use of conditions described in U.S. Pat. No. 4,313,124 which is the invention concerning the rate of temperature rise on the thermal action surface.

The arrangement of a printhead can be the combination (a linear liquid channel or a right-angle liquid channel) of the orifices, liquid channels, and electrothermal transducers disclosed in the specifications described above. The present invention also includes arrangements using U.S. Pat. Nos. 4,558,333 and 4,459,600 in each of which the thermal action surface is placed in a bent region. Additionally, it is possible to use an arrangement based on Japanese Patent Laid-Open No. 59-123670 in which a common slot is used as a discharge portion of a plurality of electrothermal transducers or Japanese Patent Laid-Open No. 59-138461 in which an opening for absorbing the pressure wave of thermal energy is opposed to a discharge portion.

Furthermore, a full line type printhead having a length corresponding to the width of the largest printing medium printable by a printing apparatus can have a structure which meets this length by combining a plurality of printheads as disclosed in the aforementioned specifications or can be a single integrated printhead.

In addition, it is possible to use not only a cartridge type printhead, explained in the above embodiments, in which ink tanks are integrated with a printhead itself, but also an interchangeable chip type printhead which can be electrically connected to an apparatus main body and supplied with ink from the apparatus main body when attached to the apparatus main body.

Adding a recovering means or a preliminary means for a printhead to the printing apparatus described above is preferable because printing can further stabilize. Practical examples of the additional means for a printhead are a capping means, a cleaning means, a pressurizing or drawing means, and an electrothermal transducer or another heating element or a preliminary heating means combining them. A predischarge mode for performing discharge different from printing is also effective to perform stable printing.

The printing mode of the printing apparatus is not restricted to one using only a main color such as black. That is, the apparatus can have at least a composite color mode using different colors and a full color mode using mixed colors, regardless of whether a printhead is an integrated head or the combination of a plurality of heads.

The above embodiments are explained assuming that ink is a liquid. However, it is possible to use ink which solidifies at room temperature or less but softens or liquefies at room temperature. In inkjet systems, the general approach is to perform temperature control such that the viscosity of ink falls within a stable discharge range by adjusting the temperature of the ink itself within the range of 30° C. to 70° C. Hence, ink need only be a liquid when a printing signal used is applied to it.

Additionally, to positively prevent a temperature rise by thermal energy by positively using this temperature rise as energy of the state change from the solid state to the liquid state of ink, or to prevent evaporation of ink, ink which solidifies when left to stand and liquefies when heated can be used. That is, the present invention is applicable to any ink which liquefies only when thermal energy is applied, such as ink which liquefies when applied with thermal energy corresponding to a printing signal and is discharged as liquid ink, or ink which already starts to solidify when arriving at a printing medium.

Furthermore, the printing apparatus according to the present invention can take the form of any of an integrated or separate image output terminal of an information processing apparatus such as a computer, a copying machine combined with a reader or the like, and a facsimile apparatus having a transmission/reception function.

[Other Embodiment]

The present invention can be applied to a system constituted by a plurality of devices (e.g., a host computer, interface, reader, and printer) or to an apparatus (e.g., a copying machine or facsimile apparatus) comprising a single device.

The present invention is not limited to the above embodiments and various changes and modifications can be made within the spirit and scope of the present invention. Therefore, to apprise the public of the scope of the present invention the following claims are made.

What is claimed is:

1. An inkjet printing apparatus comprising:

a plurality of inkjet printheads which correspond to a plurality of ink colors, each printhead having a plurality of orifices for discharging ink, discharge energy generation elements arranged in correspondence with the respective orifices to discharge the ink, ink discharge signal output means for receiving printing data and outputting ink discharge signals corresponding to printing dots, block data input means for inputting serial block data for dividing the plurality of orifices into a plurality of blocks and driving the blocks in correspondence with the ink discharge signals, the block data being provided for determining a driving order of the plurality of divided blocks, block selection signal output means for temporarily holding a signal output from said block data input means and outputting the signal output from said block data input means as block selection signals corresponding to the plurality of blocks, and driving signal output means for outputting driving signals for driving the discharge energy generation elements for discharging the ink by using the signals output from said ink discharge signal output means and said block selection signal output means; and a control circuit having printing data output means for individually outputting the printing data to said ink discharge signal output means of each printhead, latch signal output means for outputting a common latch signal to said block selection signal output means of the plurality of printheads so as to switch a hold or release of the signal output from said block data input means by said block selection signal output means, and block data output means for individually outputting the block data to said block data input means of each printhead, wherein in said control circuit, the output timing of the printing data from said printing data output means to said ink discharge signal output means and the output timing of the block data from said block data output means to said block data input means are overlapped, and wherein a discharge energy generation element of a block designated by the block data from said block data output means is driven after transmitting the block data, and said block data output means outputs next block data during driving of the discharge energy generation element.

2. The apparatus according to claim 1, wherein said control circuit further comprises driving start signal output means for outputting to said driving signal output means a driving start signal for controlling an application time of the driving signals to the discharge energy generation elements.

3. The apparatus according to claim 1, wherein each of said printheads discharges the ink by using thermal energy, and further comprises, as the discharge energy generation elements, thermal energy transducers for transducing electrical energy into thermal energy to be applied to the ink.

4. The apparatus according to claim 1, wherein the plurality of printheads correspond respectively to black, cyan, magenta and yellow color inks.

* * * * *